US010188197B2

(12) United States Patent
Fraile Nuez

(10) Patent No.: US 10,188,197 B2
(45) Date of Patent: Jan. 29, 2019

(54) BACKPACK WITH EXTRACTABLE BALLISTIC PROTECTION PACKAGES

(71) Applicants: Juan Fraile Nuez, Alpicat (ES); Ernesto Natera Asurmendi, Llagostera (ES); María Baer Pakhomova, Platja D'aro (ES)

(72) Inventor: Juan Fraile Nuez, Alpicat (ES)

(73) Assignees: JUAN FRAILE NUEZ, Alpicat (ES); ERNESTO NATERA ASURMENDI, Llagostera (ES); MARIA BAER PAKHOMOVA, Platja D'Aro (ES)

( * ) Notice: Subject to any disclaimer, the term of this patent is extended or adjusted under 35 U.S.C. 154(b) by 25 days.

(21) Appl. No.: 15/519,973

(22) PCT Filed: Oct. 21, 2015

(86) PCT No.: PCT/EP2015/074318

§ 371 (c)(1),
(2) Date: Apr. 18, 2017

(87) PCT Pub. No.: WO2016/062745

PCT Pub. Date: Apr. 28, 2016

(65) Prior Publication Data

US 2017/0332768 A1 Nov. 23, 2017

(30) Foreign Application Priority Data

Oct. 21, 2014 (ES) ..... 201431550

(51) Int. Cl.
*A45F 3/06* (2006.01)
*A45F 3/04* (2006.01)
(Continued)

(52) U.S. Cl.
CPC ..... *A45F 3/06* (2013.01); *A45F 3/04* (2013.01); *A45F 3/047* (2013.01); *A45F 3/08* (2013.01);
(Continued)

(58) Field of Classification Search
CPC .... A45F 3/06; A45F 3/04; A45F 3/047; A45F 3/08; F41H 1/02
See application file for complete search history.

(56) References Cited

U.S. PATENT DOCUMENTS 4,830,245 A * 5/1989 Arakaki ..... A45F 3/04 2/2.5
5,149,203 A * 9/1992 Sacks ..... A45C 3/00 190/125

(Continued)

FOREIGN PATENT DOCUMENTS

EP 1 076 470 3/2012
EP 2 561 773 2/2013
WO WO2012001112 * 1/2012 ..... A45F 3/04

OTHER PUBLICATIONS

International Search Report dated Dec. 23, 2015 for Appln. No. PCT/EP2015/074318.

*Primary Examiner* — Derek Battisti
(74) *Attorney, Agent, or Firm* — Pillsbury Winthrop Shaw Pittman, LLP

(57) ABSTRACT

Equipment (1) having a personal protection system. The equipment (1) is envisaged to be carried on a user's shoulders undercovered. To this end, the equipment has a backpack (2) containing a front ballistic package (10) mounted in a first compartment (6) of the backpack (2) with capability of being pulled out therefrom. The front ballistic package (10) comprises a pull-out grip (12) at a first end (14) and at a second end (16), two connecting members (18) connected to the backpack (2), and allowing the passage of the user's head during the extraction thereof. Furthermore, according to the invention there are provided compacting means (20) that cause that upon pulling out the front ballistic package (10) for protecting the user the first compartment (6) can modify the size thereof from an expanded to a compacted size notably reducing its size.

18 Claims, 10 Drawing Sheets

(51) Int. Cl.

| | |
|---|---|
| ***F41H 1/02*** | (2006.01) |
| ***F41H 5/08*** | (2006.01) |
| ***A45F 3/08*** | (2006.01) |
| *A45C 15/00* | (2006.01) |

(52) U.S. Cl.
CPC ..... *F41H 1/02* (2013.01); *F41H 5/08* (2013.01); *A45C 15/00* (2013.01); *A45F 2003/045* (2013.01)

(56) References Cited

U.S. PATENT DOCUMENTS

| | | | | |
|---|---|---|---|---|
| 5,797,140 | A * | 8/1998 | Davis | F41H 1/02 2/2.5 |
| 6,419,132 | B1 | 7/2002 | Reed | |
| 6,685,071 | B2 * | 2/2004 | Prather | A45C 15/00 2/2.5 |
| 7,441,278 | B2 * | 10/2008 | Blakeley | F41C 33/06 2/102 |
| 9,351,557 | B2 * | 5/2016 | Inouye | A45F 3/06 |
| 9,820,558 | B1 * | 11/2017 | de Geus | A45F 4/02 |
| 9,999,290 | B2 * | 6/2018 | Klein | A45F 3/08 |
| 2009/0014490 | A1 * | 1/2009 | Bradley | A45C 13/008 224/576 |
| 2012/0292353 | A1 * | 11/2012 | Andersen | A45F 3/06 224/149 |
| 2014/0252059 | A1 * | 9/2014 | Paduano | A45F 3/047 224/637 |

* cited by examiner

BACKPACK WITH EXTRACTABLE BALLISTIC PROTECTION PACKAGES

CROSS-REFERENCE TO RELATED APPLICATIONS

This is the U.S. National Stage of PCT/EP2015/074318 filed Oct. 21, 2015, which in turn claims priority to Spanish Application No. P201431550, filed Oct. 21, 2014, the entire contents of all applications are incorporated herein by reference in their entireties.

FIELD OF THE INVENTION

The invention relates to an equipment having a personal protection system suitable for being carried on a user's shoulders comprising a backpack having two shoulder straps and at least one first upper compartment accessible from the outside through a first operable closing means, a front ballistic package mounted with capability of being pulled out through said first closing means in said first compartment comprising an pull-out grip at a first end and at a second end, opposite to said first end, two connecting members between said front ballistic package and said backpack, spaced apart from one other to allow for the passage of said user's head, it being possible to modify the configuration of said equipment between an undercover position in which said front ballistic package is inserted in said first compartment and said grip projects through said first closing means and is accessible by said user without having to remove the backpack from his shoulders and a protection position in which said front ballistic package is pulled out from said first compartment, facing said backpack such that it is configured for covering at least the vital organs of said user.

STATE OF THE ART

Conventionally, equipment having a backpack-like personal protection system from which at least one front ballistic package may be pulled out, for the purpose of offering the user thereof an adequate level of protection against cutting weapons or firearms, is known. Such equipment has the advantage of being discreet and therefore allows the user to operate in an undercover way. ES1076470U of this applicant shows an example of this type of equipment having a personal protection system. As far as the level of personal protection is concerned, such equipment works satisfactorily. Nevertheless, such equipment has certain drawbacks which have room for improvement as detailed hereinafter.

In the first place, the front ballistic package occupies a notable space of the volume of the backpack. Normally, owing to the notable weight of the ballistic package, this is contained in a compartment close to the user's back or at least as close as possible. A first problem arises from the fact that such equipment usually carries, at least, another compartment for loading additional equipment specific for the utility it is desired to give to the unit. Consequently, after the ballistic package has been pulled out to cover the user's chest, the compartment containing it is left empty. Simultaneously, the compartment farther away from the back is full of operation material. This means that the load in this latter compartment moves a lot relative to the backpack, making the user's movements extremely difficult. When the user is running, the load may randomly move and consequently cause a loss of agility and stability under operational circumstances.

On the other hand, a further improvable feature of the known equipment is the protection of the lower portions of the trunk, since in favour of the compactness and weight of the protection unit, the protection is frequently sacrificed.

This type of equipment is commonly used in military environments. Owing to the features thereof, the known equipment does not facilitate a speedy, agile get away for soldiers infiltrated in enemy lines in the case of extreme danger and the need for an urgent retreat.

A further problem of such equipment is that it does not allow an undercover operation to be combined with the immediate availability of the weapon in a reasonably short period of time. This option is extremely relevant particularly when a life-threatening situation arises.

Another drawback of this type of equipment is that independently of whether the front ballistic package is pulled out or not, the backpack grips are an obstacle to the hanging of a weapon and to this weapon being easily accessible.

SUMMARY OF THE INVENTION

It is an object of the invention to provide a weapon system integrated in equipment having a personal protection system suitable for being carried on a user's shoulders of the type indicated at the beginning, wherein when the personal protection is pulled out, the user's movements are facilitated and thus his personal safety is improved.

This purpose is achieved by equipment of the type indicated at the beginning, characterized in that it further comprises compacting means which connect the front ballistic package with the backpack, such that the first compartment can modify the size thereof between an expanded size when the equipment is in the undercover position and a compacted size when the equipment is in the protection position.

When the front ballistic package is pulled out, the first compartment is empty. In this situation, if the user moves because, for example, he is running or ducks, the load contained in the remaining compartments of the backpack negatively affects his stability and speed. This movement of the material located in the rear container hinders the user's agility of movement. Thus, the compacting of this volume improves the user's mobility and agility and/or prevents the equipment being hooked up on anything projecting from the surface against which the user may drag when, for example, he is trying to move in limited spaces. As a consequence of all this, the user's personal safety is even further improved.

The invention further includes a number of preferred features that are object of the dependent claims and the utility of which will be highlighted hereinafter in the detailed description of an embodiment of the invention.

A further object of the invention consists of reducing as far as possible the weight of the compacting means while maintaining the operative effectiveness of the unit. To this end, the first compartment preferably comprises a surface near to the contact surface between the backpack and the user's back and a surface remote from the contact surface, facing the near surface, with the compacting means comprising at least one cable connecting said near and remote surfaces and which at least at one end is attached to the front ballistic package, with the cable having such a length that when the equipment is in the protection position, the first compartment is in the compacted size. In the invention, the idea of "cable" applied to the pulling member which the compacting means according to the invention comprise refers both to a cable of any material, such as a thread, or cord which may withstand the loads appearing when the front ballistic package is pulled out.

As already mentioned above, the personal protection vests often sacrifice the protection of the lower parts of the body in favour of compactness. To solve this problem, in one embodiment of the invention, the equipment comprises a rear protective ballistic package associated with said backpack and configured to protect the said user's vital organs at the rear and a sacroiliac ballistic package at the bottom area of the equipment, movable between a hidden position and a unfolded position in which the sacroiliac ballistic package covers the user's sacroiliac region.

On the other hand, with a view to improving the ergonomics of the equipment, the backpack comprises a second independent lower compartment, accessible from the outside through a second operable closing means and containing the sacroiliac ballistic package in such a way that it can be pulled out.

In a further embodiment of improved security, the equipment further comprises a sacroiliac ballistic plate functionally connected to the sacroiliac ballistic package and provided at the bottom area of the equipment movable between a hidden position and an unfolded position.

Additionally, if even more security is desired in this area, in one embodiment of the equipment, this may further comprise a pelvic ballistic package functionally connected to the front ballistic package with the pelvic ballistic package being unfoldable from the first end when the equipment adopts the protection position, such that in the unfoldable position the pelvic ballistic package covers the user's pelvic region.

In one embodiment of maximum frontal security, the equipment further comprises a pelvic ballistic plate functionally connected to the pelvic ballistic package and provided at the bottom area of said equipment movable between a hidden position and an unfolded position.

In the case of operations of special groups infiltrated in enemy areas it is necessary for the equipment to allow rapid safe exfiltration, while retaining, nevertheless, all the material. In another embodiment, on the contact surface with the user's back, the backpack comprises a harness incorporating an exfiltration anchorage. In the invention, the term "exfiltration" is understood to mean a quick extraction from the area of operations. Thanks to the exfiltration anchorage, the user may hook the equipment to a cable or rope lowered from a helicopter to be quickly evacuated and moved to a new location where the user may safely get into the aircraft without risking the security of his comrades.

Here again, in the case of the harness, the invention proposes improving also the comfort and ergonomics for the user. To this end, the harness comprises first straps as leg straps at the bottom area of the backpack and second straps connected to the first straps, which extend from the sacroiliac area to the cervical area of the backpack and are coupled with said exfiltration anchorage. The exfiltration anchorage may be placed at the waist, but placement thereof in the cervical area improves the operability of the exfiltrated personnel, being able to maintain his fire sector and repel any menace during the exfiltration. Also, should the user not have had time to correctly place the harness, closing the abdominal strap and the breast strap allows him to hook up quickly and be carried away hanging by his shoulders.

In an alternative embodiment, the equipment comprises a third independent lower compartment accessible from the outside through a third operable closing means containing the first straps. This feature facilitates the user's movements when it is not needed to use the harness and improves discretion in the case of undercover operations.

Another problem contemplated by the invention, independently of whether the operation is undercover or not, is to facilitate immediate access for the user to a weapon in risk situations. Further, the intention is to prevent the weapon being seized by a third person. Finally, it is necessary for the whole to be accompanied by easy handling of the weapon associated with the equipment. To solve this problem, in an improvement of the invention, it is contemplated that the equipment comprises a weapon suspension device comprising first and second attachment points provided at the front area of the equipment at the height of the user's shoulders, a first suspension member extending between the first and second attachment points and a second suspension member transversely mounted at a first end on said first suspension member slidingly between said first and second attachment points and connected to said weapon at a second end. Thanks to this, the user can have the weapon comfortably hanging from the equipment and furthermore thanks to the sliding along the transverse connector he can manipulate the weapon with the right hand and the left hand to offer the smallest possible body surface to the enemy.

Optionally, the transverse member has on at least one of the ends thereof, means for connection with the first or second attachment point, the connecting means being movable between an open position and a closed position to disconnect the connection between the transverse member and the first or second attachment point. This allows the connecting means to be disconnected from one side to hang the weapon from one side of the user. The connecting means may be a fixture, such as a spring hook or the like.

On the other hand, the handling of the weapon can lead to entanglement in the suspension system. To avoid this problem, it is preferably contemplated that the second suspension member comprises second means of connection with a fixed part slidingly mounted between said first and second attachment points and provided with a shaft and a part rotating relative to the shaft.

Another problem of the known equipment consists of optimally combining discretion in an undercover operation with the immediate availability of a weapon in case of need. To solve this problem in a preferred embodiment the front ballistic package comprises holding means, configured to hold a weapon at the front part of the front ballistic package such that when the configuration of the equipment is changed between the undercover position and the protection position, the weapon is moved fixedly with the front ballistic package. Thanks to this, immediate access to the weapon is provided.

Yet another problem which can appear during the use of the equipment according to the invention is that of involuntary pulling out of the front ballistic package, for example, when the backpack is picked up from the floor with the grip. To solve this problem, preferably, the equipment according to the invention comprises securing means adapted to releasably connect the pull-out grip to the backpack, the securing means being movable between a securing position in which the grip and the backpack are directly attached to each other through the securing means and a release position in which the grip is released from the backpack to allow the front ballistic package to be pulled out.

In a particularly simple embodiment the securing means comprise at least one grip eyelet provided on said grip, a pair of backpack eyelets, spaced apart at least by the width of said grip, a first longitudinal member configured to be snugly guided through the eyelets, the grip and backpack eyelets and the longitudinal member being configured so that, starting out from the securing position, in which the grip eyelet is aligned between the pair of backpack eyelets and the first longitudinal member is inserted in the grip and backpack eyelets, on passing to the release position, the first longitudinal member is moved at least out of the grip eyelet.

It is also desirable for the securing means to be enabled and disabled without it being necessary to take the equipment off. Thus, optionally, the longitudinal member is flexible and the end of the first longitudinal member opposite to the end is inserted in said grip and backpack eyelets, is connected to a movable blocking member provided on one of said shoulder straps, within the reach of the user's hand, mounted movably at least in the distance between said securing position and said release position of said securing means.

Finally, another object of the invention is that the opening of the compartment containing the front ballistic package be as agile and quick as possible. To this end, in one variant of the invention the first operable closing means comprises a plurality of closing means eyelets adjacent both sides of the first upper compartment and a second flexible longitudinal member fixedly mounted projecting from each of the sides of the pull-out grip and which in the undercover position is inserted snugly guided in the plurality of closing means eyelets the second longitudinal member having such a length that when the equipment passes from the undercover position to the protection position, the second longitudinal member is withdrawn from the plurality of closing means eyelets.

Likewise, the invention also includes other features of detail illustrated in the detailed description of an embodiment of the invention and in the accompanying figures.

BRIEF DESCRIPTION OF THE DRAWINGS

Further advantages and features of the invention will become apparent from the following description, in which, without any limiting character, preferred embodiments of the invention are disclosed, with reference to the accompanying drawings in which.

DETAILED DESCRIPTION OF EMBODIMENTS OF THE INVENTION

Figure 1:
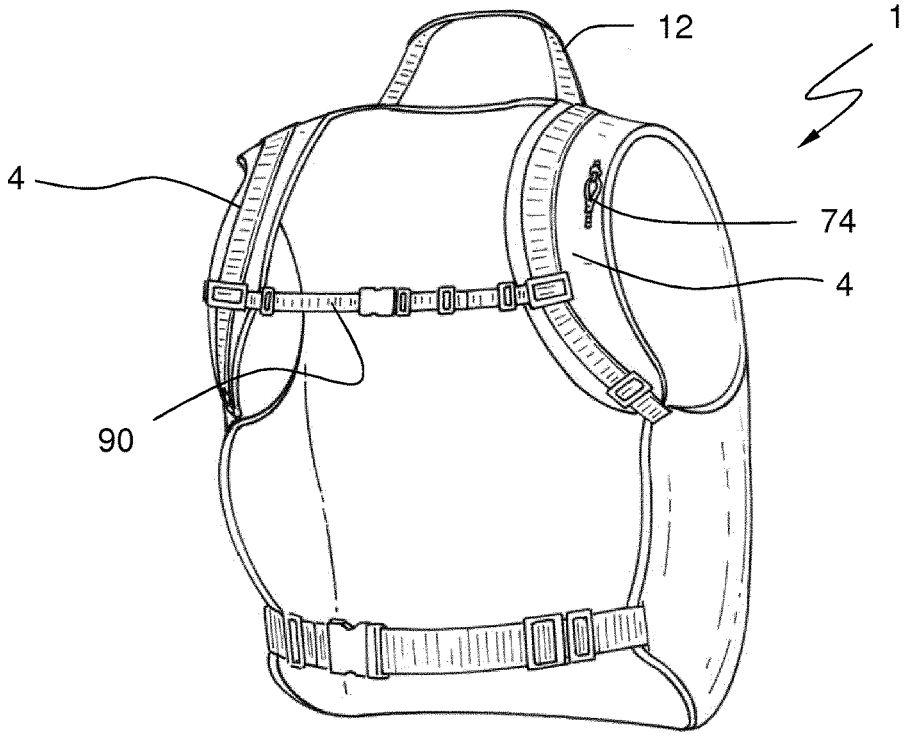
FIG. 1 is a schematic front perspective view of the equipment having a personal protection system according to the invention, with the front ballistic package in the undercover position.
Figure 2:
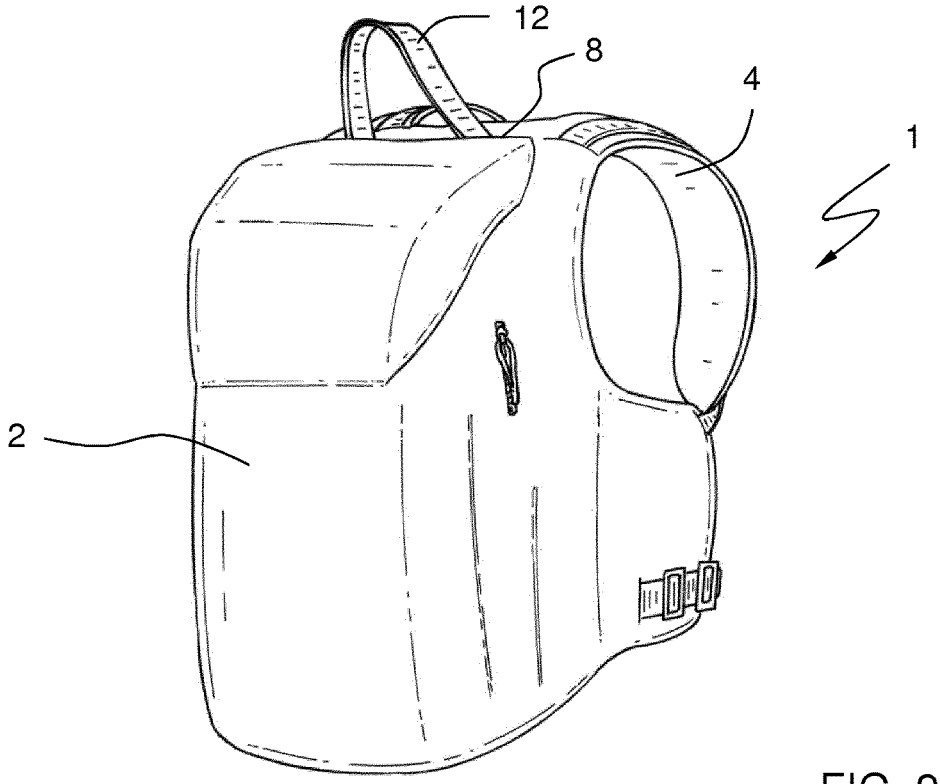
FIG. 2 is a schematic rear perspective view of the equipment of FIG. 1 with the front ballistic package in the hidden position.

As is to be seen in FIG. 1, the equipment 1 according to the invention, incorporating a personal protection system, is devised to be carried on the shoulders of a user in a discreet way to facilitate an undercover operation. This type of equipment is particularly applicable in the military, police or security fields.

The equipment 1 comprises a backpack 2 having two shoulder straps 4 and a main compartment 78 for functioning as a load container for the objects the user has to carry. The backpack 2 may be manufactured from any material providing an adequate tear and abrasion resistance. On the other hand, the backpack 2 has a first upper compartment 6 containing a front ballistic package 10 separate from the rest of the load inserted in a front containing cover 80 accessible from the outside by way of a first operable closing means 8.

In the invention, the ballistic package(s) used are made in a way known in the art, such as, for example, from one or several layers of fibres based on aramids, terpolyaramides, technical plastics, metals, ceramics, carbon composites, or combinations thereof, known in the art under their trade names such as Dyneema®, Spectra®, Glodflex®, Kevlar® or others.

In this embodiment, within the front containing cover 80 there is also provided an optional front ballistic plate 82. The front ballistic plate 82 improves the level of protection of the equipment, but is not essential for having a minimum level of protection. Thanks to the ballistic plates, the equipment according to the invention further to offering protection against handguns or cutting weapons, also offers protection against long firearms, with the protection afforded by the level of threat supported by the corresponding ballistic plates. It should also be said that it is not necessary for the containers of the ballistic packages and the ballistic plates to be separated from one another.

Figure 3:
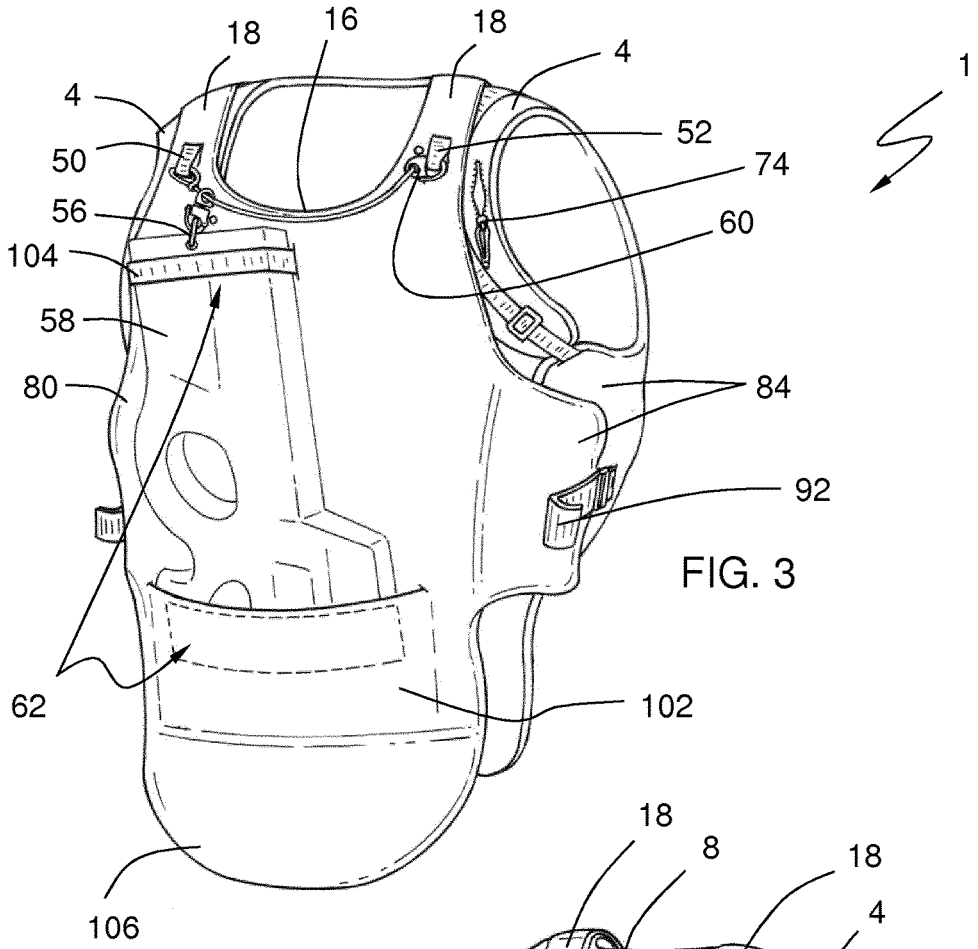
FIG. 3 is a schematic front perspective view of the equipment of FIG. 1 with the front ballistic package in the protection position.

Optionally, the equipment 1 has first and second lateral extensions 84 in which the corresponding ballistic package is housed and which moreover to increase even more the level of protection, may have lateral ballistic plates not shown in the figures. Furthermore, these lateral ballistic plates may also be inserted and withdrawn from their corresponding housings in the ballistic packages. As is to be seen in FIGS. 3 and 4, the lateral extensions 84 must overlap to have a good level of lateral protection.

The equipment 1 and in particular the backpack 2 and the front containing cover 80 provide mating closing means 92 which, when the first and second lateral extensions 84 are overlapped over each other, form the personal protection vest. These closing means 92 may be of any known type, but preferably will be of a textile fastening type such as Velcro®, Cosmolon®, or the like.

On the other hand, the ballistic plates are made from metal alloys, ceramics, technical plastics, aramids, terpolyaramides, carbon fibres and others and may be made from a single material or in combinations of the aforementioned ones, in thicknesses appropriate for the level of threat.

The separation between compartments 78, 6 is preferred, but is in no way essential for the invention, namely, the front ballistic package 10 could be located directly in the main compartment 78 of the backpack 2.

Likewise, in a specially preferred form, the equipment 1 has a protective rear ballistic package 28 associated with the backpack 2 and configured to protect the user's vital organs from behind.

The front ballistic package 10, which is mounted in a way it can be pulled out through the first closing means 8, comprises a pull-out grip 12 at a first end 14. At a second end 16, opposite to the first end 14, there are provided two connecting members 18 which connect the front ballistic package 10 and the backpack 2. The connecting members 18 are separated from one another to allow the passage of the user's head during the movement of pulling out and placing the front ballistic package 10.

The configuration of the equipment 1 may be changed between the position of undercover use, according to FIG. 1, 2, 5 or 14A, and the protection position, according to FIG. 3, 4, 6 or 14C.

Figure 5:
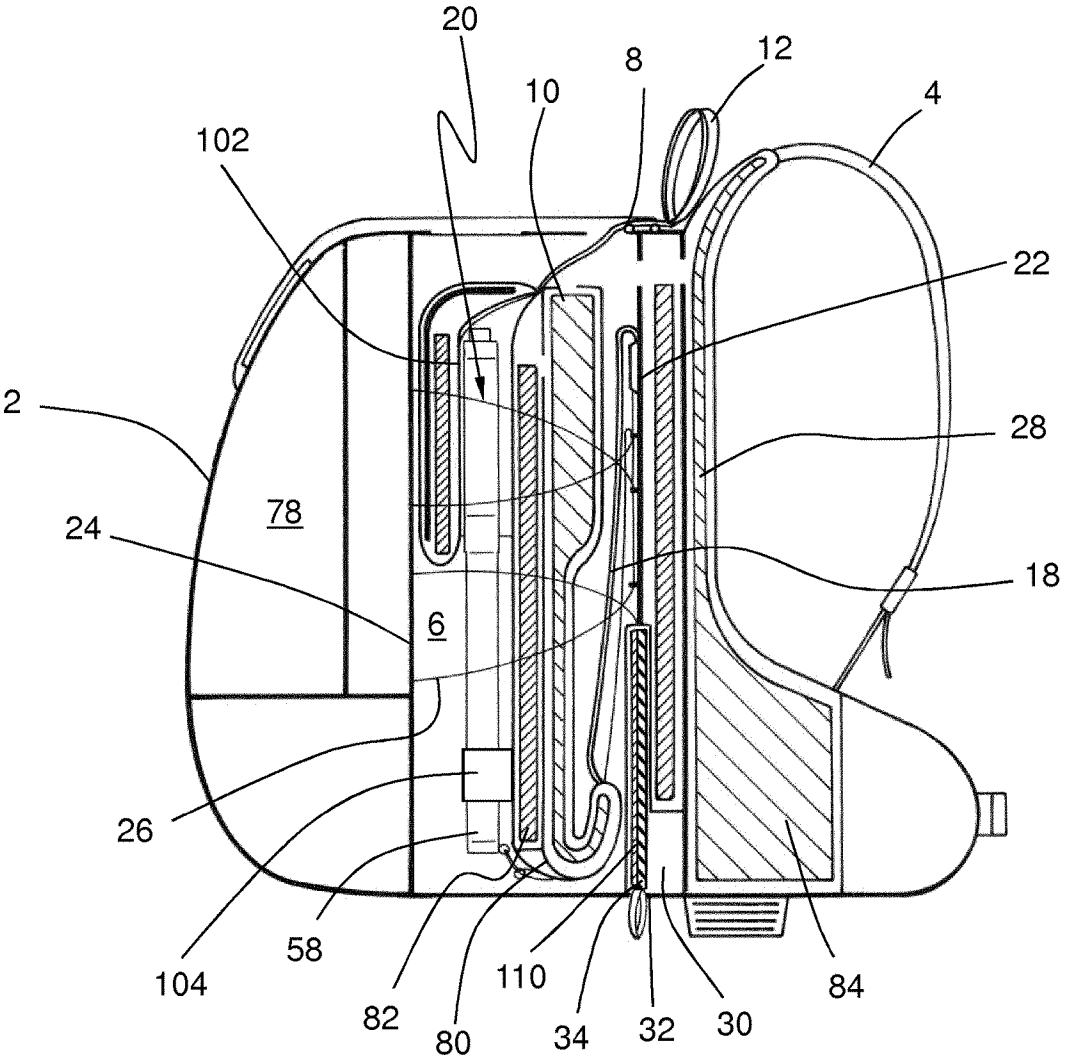
FIG. 5 is a schematic side view of the equipment having a personal protection system according to the invention, with the front ballistic package in the undercover position and partly cut away in the longitudinal direction.

In the undercover position, also shown in FIG. 5, the front ballistic package 10 is inserted in the first compartment 6 and the grip 12 projects through the first closing means 8. In this position the grip 12 is accessible for the user without having to take the backpack 2 off his shoulders, as may be seen in FIG. 14A. In this position, the user carries the equipment 1 hanging from his shoulders without raising any suspicion since any third party only sees the backpack 2.

In the case where the backpack 2 is left on the ground and to prevent the front ballistic package 10 from opening out when it is manipulated with the grip, it is contemplated that the equipment 1 comprises securing means 64 adapted to releasably connect the pull-out grip 12 with the backpack 2. These securing means 64 may move between a securing position, according to FIG. 7 and a release position, according to FIG. 8.

Figure 7:
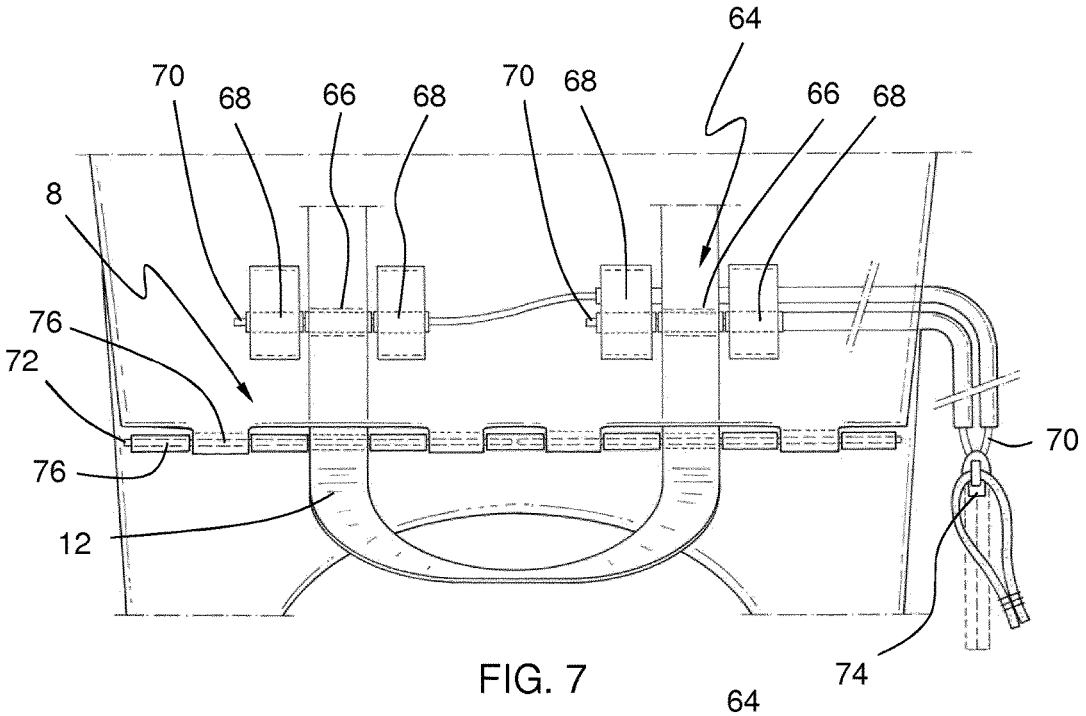
FIG. 7 is a schematic detail plan view from above of the closing means of the first compartment of the backpack in the securing position.

In the securing position the grip 12 and the backpack 2 are directly connected together by the securing means 64. As can be seen in FIG. 7, preferably these securing means 64 are a grip eyelet 66 for each side of the grip 12 and a pair of backpack eyelets 68 for each of the grip eyelets 66. The backpack eyelets 68 are spaced apart in at least the width of the grip 12. Once the grip and backpack eyelets 66, 68 are aligned, a first longitudinal member 70 is passed, snugly guided, through them, according to FIG. 7. To improve the guiding of the first longitudinal member 70 in the grip and backpack eyelets 66, 68, it is contemplated to place a plastic cylinder having an outer diameter adjusted to the grip and backpack eyelets 66, 68 and having an inner diameter adjusted to the outer diameter of the first longitudinal member 70.

The grip and backpack eyelets 66, 68 and the first longitudinal member 70 of the equipment 1 are configured so that starting out from the securing position of FIG. 7, by pulling the first longitudinal member 70, this moves at least out of each of the grip eyelets 66 to the release position, in which the grip 12 is uncoupled from the backpack 2.

Figure 8:
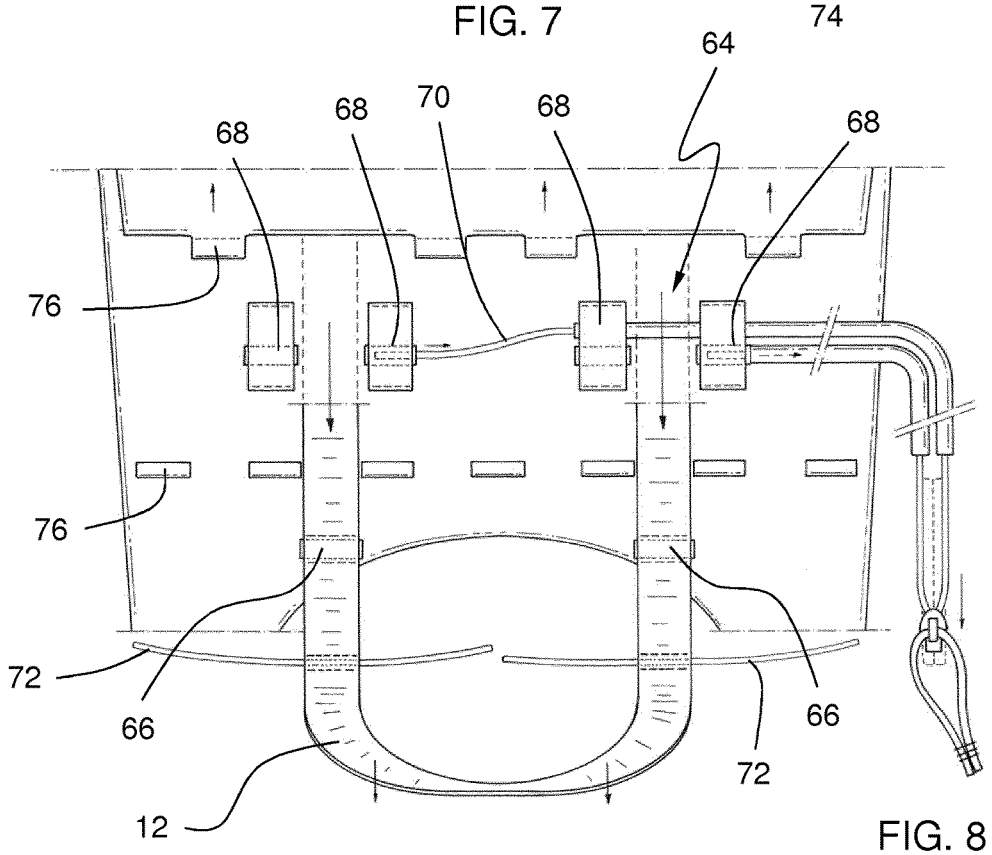
FIG. 8 is a schematic detail plan view from above of the closing means of the first compartment of the backpack in the release position.

Then, in the release, position according to FIG. 8, the grip 12 is freed from the backpack 2 and the front ballistic package 10 may be pulled out according to the afore described sequence.

It should also be mentioned that in the improved embodiment shown in the figures and which solves the problem of avoiding the accidental opening of the grip 12, it is contemplated that the longitudinal member 70 be flexible. Furthermore, at the end of the first longitudinal member 70 opposite to the end inserted in the grip and backpack eyelets 66, 68, the longitudinal member 70 is connected to a movable blocking member 74, preferably a zipper. This zipper, provided on one of said shoulder straps 4, within the reach of the user's hand, is movable at least in the distance between the securing position and the release position of the securing means 64.

Also, another of the problems detected in the known solutions of equipment incorporating a pull-out front ballistic package similar to that of the invention, is the difficulty of getting the closing means of the compartment containing the front ballistic package to work reliably, both for closing the compartment and for opening it rapidly.

Thus, in the preferred embodiment of the invention, the first operable closing means 8 comprises a plurality of adjacent alternate closing eyelets 76 on both sides of the upper first compartment 6 and a flexible second longitudinal member 72. As is to be seen in FIGS. 7 and 8, the second longitudinal member 72 is fixedly mounted projecting out from each of the sides of the pull-out grip 12. In the undercover position, the second longitudinal member 72 is snugly inserted in the plurality of closing means eyelets 76 to guarantee the correct closing of the first container 6. The second longitudinal member 72 has such a length that when the grip 12 is pulled to change the equipment 1 from the undercover position to the protection position it is withdrawn from the plurality of closing means eyelets 76.

Figure 6:
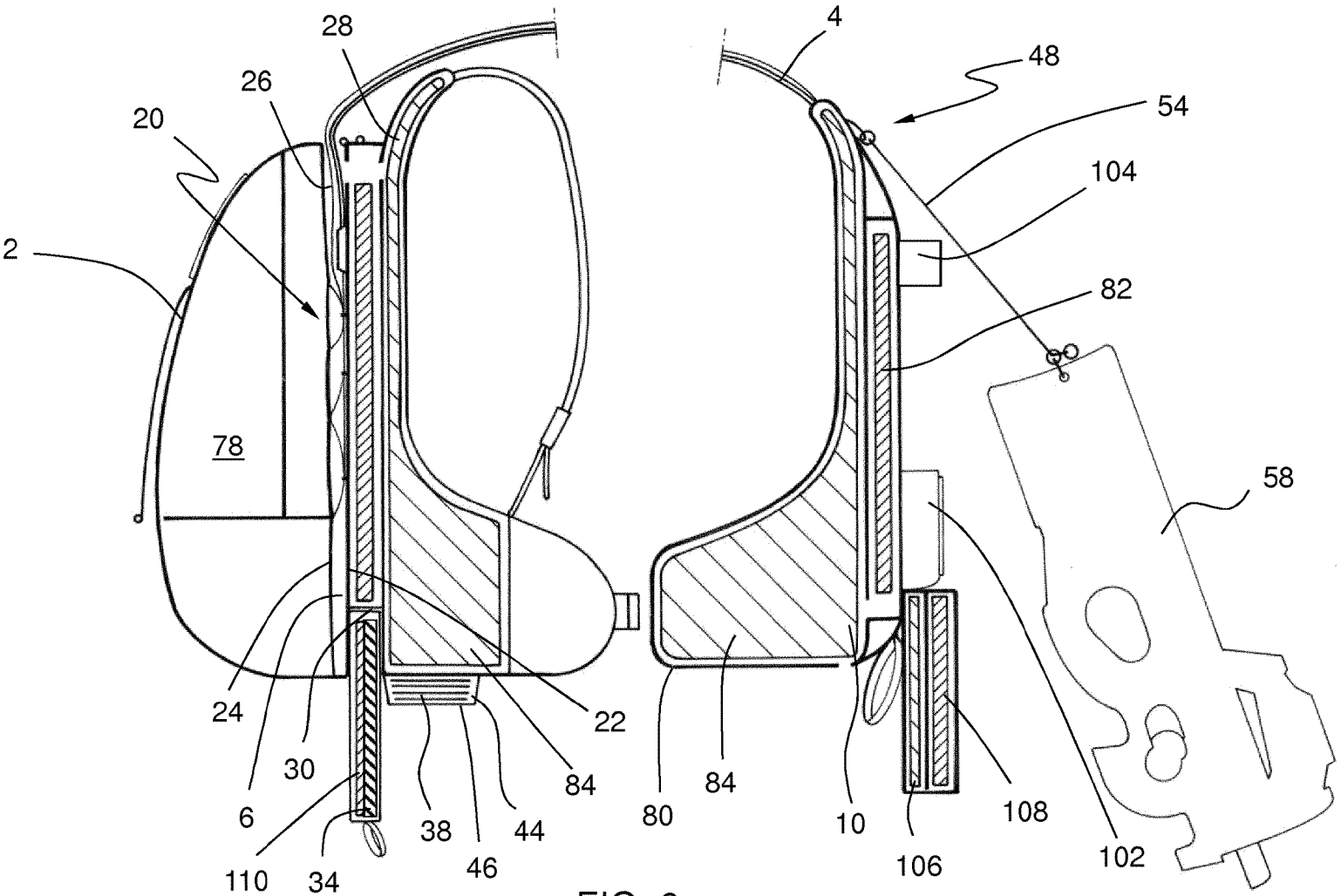
FIG. 6 is a schematic side view of the equipment of FIG. 5, with the front ballistic package in the protection position and partly cut away in the longitudinal direction.
Figure 14A:
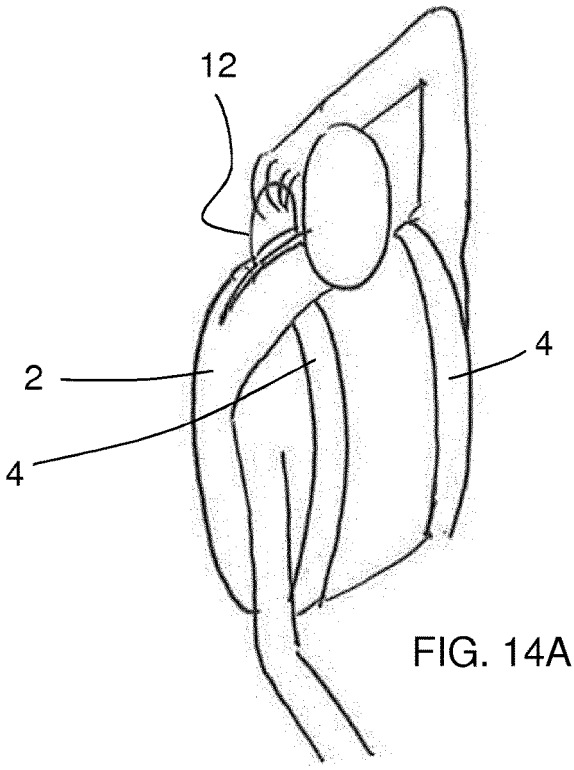
FIGS. 14A to 14C are schematic views of the sequence of pulling out the personal protection system according to the invention.
Figure 14B:
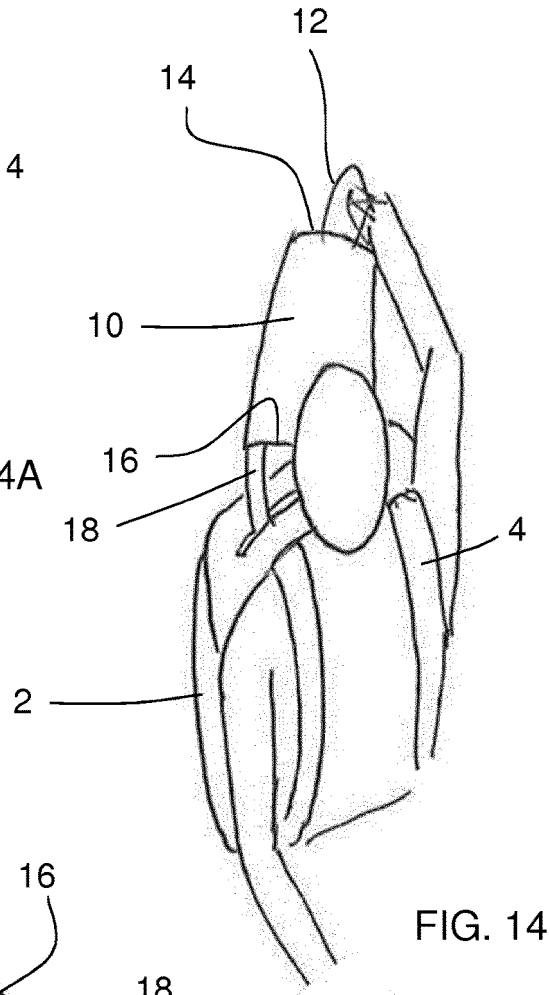
Figure 14C:
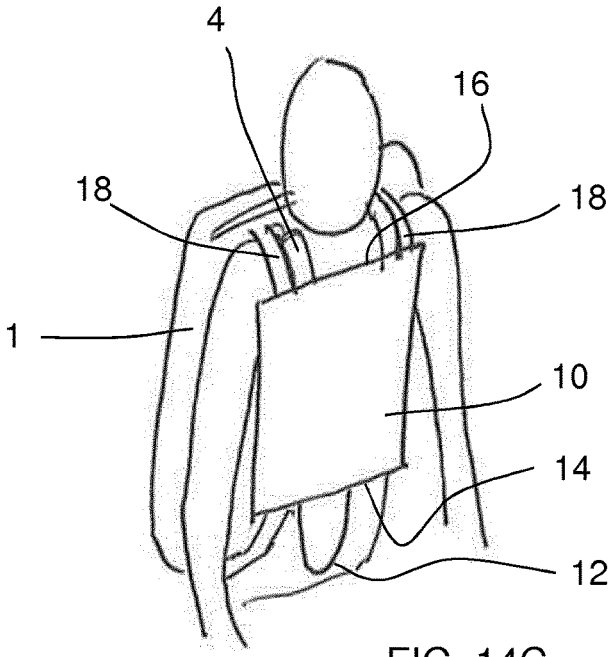

As shown in the sequence of FIGS. 14A to 14C, from the undercover position the user pulls the grip 12 upwards, until the front ballistic package 10 is fully pulled out from the backpack 2 and the second end 16 is above the user's head. Then, from this position, the front ballistic package 10 is pulled forward in a rotary movement and is placed over the user's chest in said protection position. In the protection position, the front ballistic package 10 is pulled out from the first compartment 6 and covers the user's chest, i.e., the front ballistic package 10 is facing the backpack 2 as shown in FIG. 6. In this position, the front ballistic package 10 covers at least the user's vital organs, approximately above the waist, while thanks to the pelvic ballistic package 106, the area comprised between the user's waist and pelvis is additionally protected.

As already mentioned above, another of the objects of the invention is to facilitate the user's movements and consequently improve the safety level. To this end, the equipment 1 comprises compacting means 20 connecting the front ballistic package 10 to the backpack 2. This connection between both members is configured such that the size of the first compartment 6 may be changed between an expanded size and a compacted size.

The expanded size corresponds to the size of the equipment 1 when it is in the undercover position, i.e. with the front ballistic package 10 concealed in the first compartment 6.

The compacted size corresponds to the situation in which the equipment 1 is in the protection position. Thanks to this compacting, the load (not shown in the figures) contained in the main compartment 78 can no longer oscillate or move randomly. This allows the user to be able to run comfortably without his stability and speed being affected, or drag against a wall when taking cover, reducing the risk of the backpack 2 being snagged.

In an embodiment shown in FIGS. 5, 6, the first compartment 6 is delimited between a surface 22 near to the contact surface between the backpack 2 and the user's back and a surface 24 remote from the contact surface, which is facing the near surface 22. Thus, the compacting means 20 consist of at least one cable 26 connecting the near and remote surfaces 22, 24 in zigzag. When the solution is a single cable, its ends are attached to the front ballistic package 10. The cable or cord may be made from any material known in the art, such as, for example, a braided polyamide cable.

When the user pulls out the front ballistic package 10 by pulling on the grip 12, thanks to the cable 26 having an appropriate length, the cable of the first compartment pulls on the remote surface 24 and reduces the volume of the backpack, by drawing the near and remote surfaces 22, 24 closer to each other.

Alternatively, this solution may be carried out by two cables 26 which, after having been threaded in zigzag between holes provided in the near and remote surfaces 22, 24, are associated at one end with the front containing cover 80 and at the opposite end with the near and remote surfaces 22, 24.

In FIG. 6 it may be clearly seen that when the equipment 1 is in the protection position, the first compartment 6 is in the compacted size.

Figure 15:
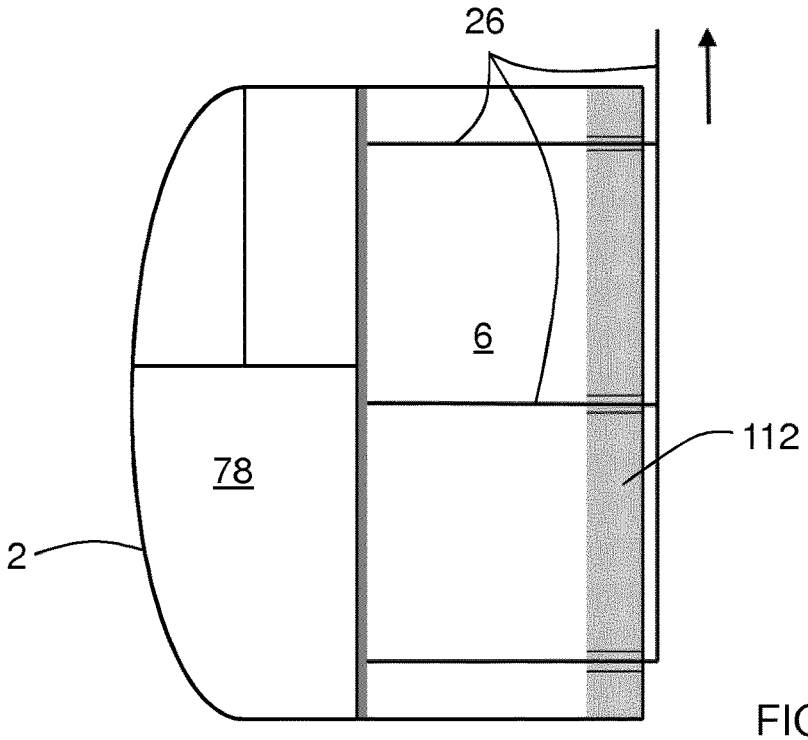
FIG. 15 is a schematic side view of another embodiment of the equipment having a personal protection system according to the invention, with the first compartment in the expanded size.
Figure 16:
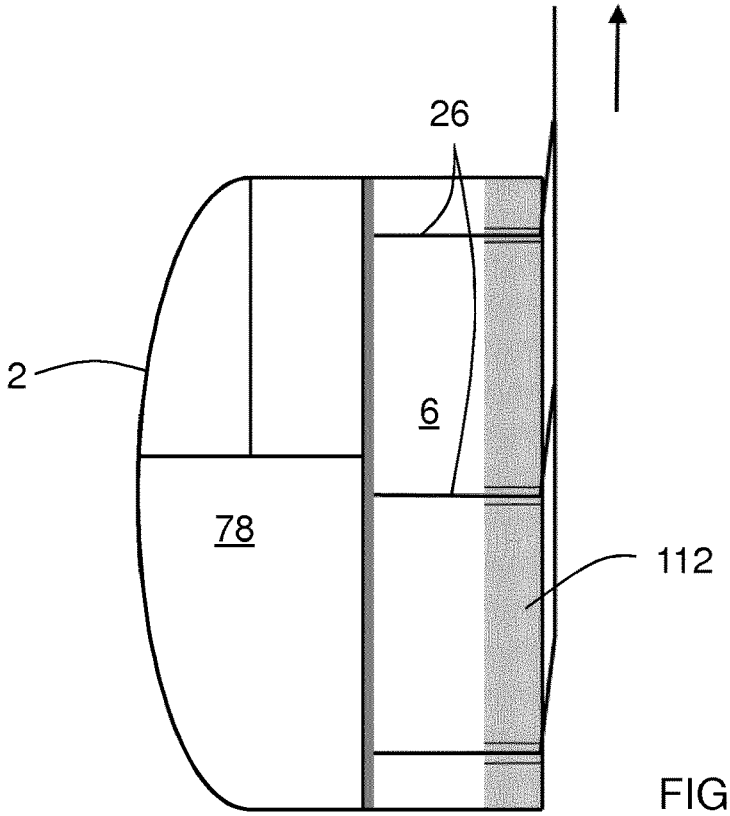
FIG. 16 is a schematic side view of the equipment of FIG. 15, with the first compartment in the compacted size.

In another embodiment of the equipment 1 shown in FIGS. 15 and 16, the compacting means 20 connecting the front ballistic package 10 with the backpack 2 are a plurality of flexible longitudinal members, such as for example, cables 26, cords or the like which are attached, at one end to the rear container 78, preferably on the outside, so as not to interfere in the process of pulling out the front ballistic package 10 which is not shown in the figures. At the other end, these cables 26 are attached to the connecting members 18 or suspension straps of the front containing cover 80 of the front ballistic package 10, passing through holes formed in one, or several stiffening plates 112 made from a metallic or synthetic material, which are fixedly attached to the back of the backpack 2. When the front ballistic package 10 is unfolded, the suspension straps move over a particular length coinciding with the distance that the cables 26 have to cover to retract the rear container 78 from the position of FIG. 15 to the position of FIG. 16.

At personal protection level, it should be mentioned that to further improve the protection without the need to sacrifice the compactness of the unit, it is contemplated that the equipment 1 also have a sacroiliac ballistic package 34 at the bottom area of the backpack 2. In the undercover position of the equipment 1, this sacroiliac ballistic package 34 is not seen, since the backpack 2 has a second independent lower compartment 30, accessible from the outside through a second operable closing means 32 and which contains said sacroiliac ballistic package 34 in a way it can be pulled out.

Figure 4:
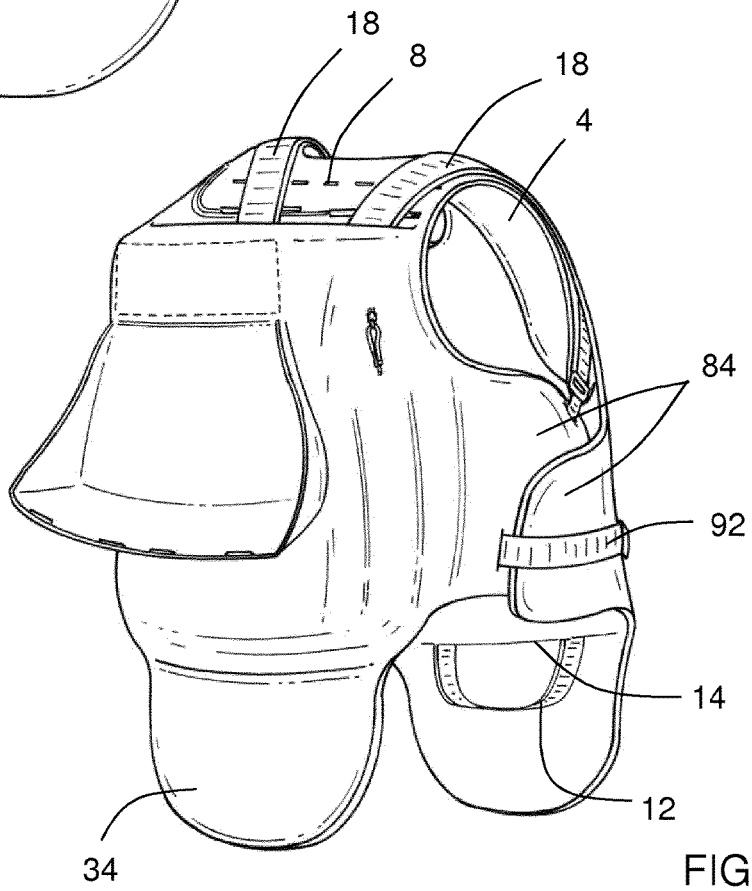
FIG. 4 is a schematic rear perspective view of the equipment of FIG. 1 with the front ballistic package in the protection position.

The sacroiliac ballistic package 34 is movable between a hidden position, shown in FIGS. 1 and 5 and an unfolded position to be seen in FIGS. 4 and 6. Again, in spite of not having been shown, the equipment 1 could be fitted with a sacroiliac ballistic plate 110.

Optionally, to improve the front protection, the front containing cover 80 is provided also with a pelvic ballistic package 106 functionally connected to the front ballistic package and which unfolds from the first end 14 when the equipment is in the protection position. Further, the pelvic ballistic package may optionally be accompanied with a pelvic ballistic plate 108, both parts being configured to protect the user's lower abdomen and the pelvic area.

Figure 9:
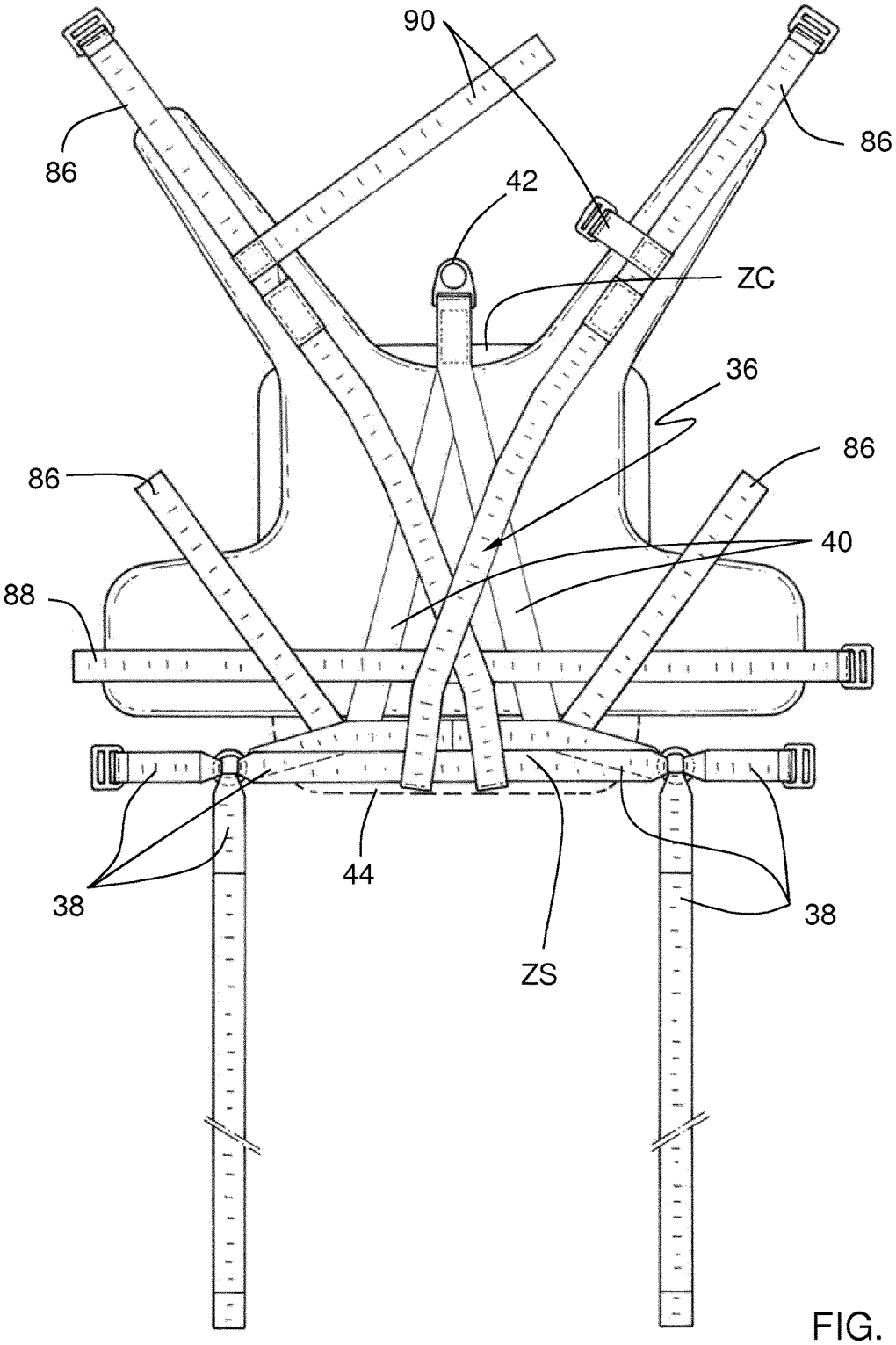
FIG. 9 is a front detail view of the inner exfiltration harness of the equipment according to the invention.

FIG. 9 clearly shows that on the surface 22 near to the user's back and, more particularly the backpack 2 surface of the equipment 1 in contact with the user's back may be provided with a harness 36 incorporating an exfiltration anchorage 42. Thanks to this, in the face of urgent exfiltration situations the user can get out of the danger zone immediately. The harness 36 may have the exfiltration anchorage 42 in the waist area.

As may be seen in FIG. 9, the harness is configured in such a way as to take advantage of the structure of the backpack 2. Particularly, it is provided with two shoulder straps 86 which are provided inwardly of the shoulder straps 4 of the backpack 2, a waist strap 88 and a breast strap 90 which in the closed position connects both shoulder straps 86 with one another. These straps coincide with the structural straps of the backpack 2. Additionally, the harness 36 comprises first straps 38 as leg straps at the bottom area of the backpack 2 and second straps 40 connected to said first straps 38, which extend from the sacroiliac area ZS to the cervical area ZC of the backpack 2 and which are coupled with the exfiltration anchorage 42. The straps of the harness 36 are straps woven from materials such as polyamide or others guaranteeing the load factor appropriate for the work to be done.

To improve the ergonomics of the unit and prevent the straps from being visible in the undercover position, there is provided a third independent lower compartment 44 and therein there are contained the first straps 38 and to which access may be had through a third operable closing means 46 not shown in detail in the figures.

On the other hand, the invention also solves the technical problem of providing an immediate access to a weapon 58 for risk situations. This need appears especially in cases of soldiers on guard duties. In these situations, it is inconvenient to have to hold the weapon all the time. Nevertheless, a risk situation may arise in a matter of seconds. Consequently, in this short space of time, it is absolutely necessary, independently of whether the operation is undercover or not, for the user to have the weapon within hand's reach.

Figure 10:
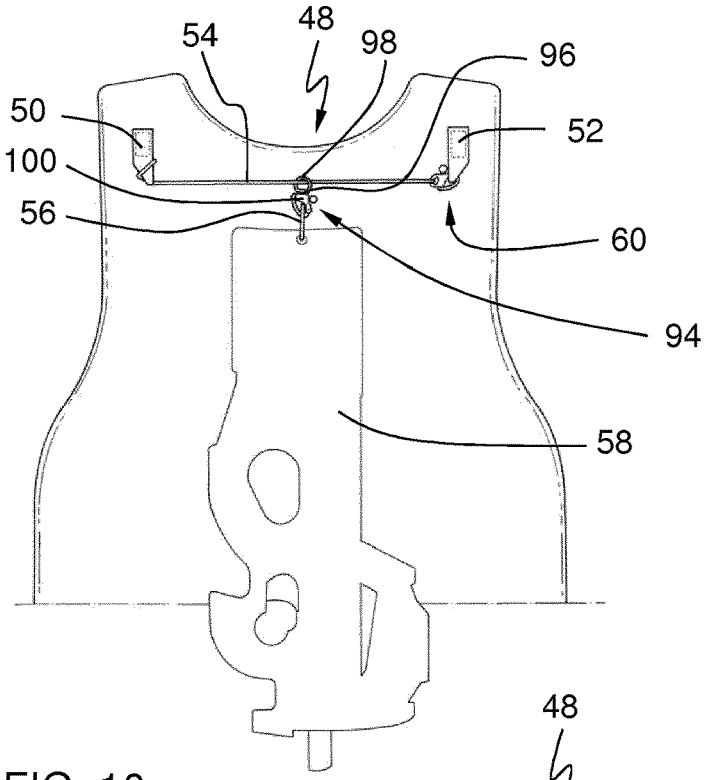
FIG. 10 is a front view of the weapon suspension device in a centre position in the equipment according to the invention.
Figure 11:
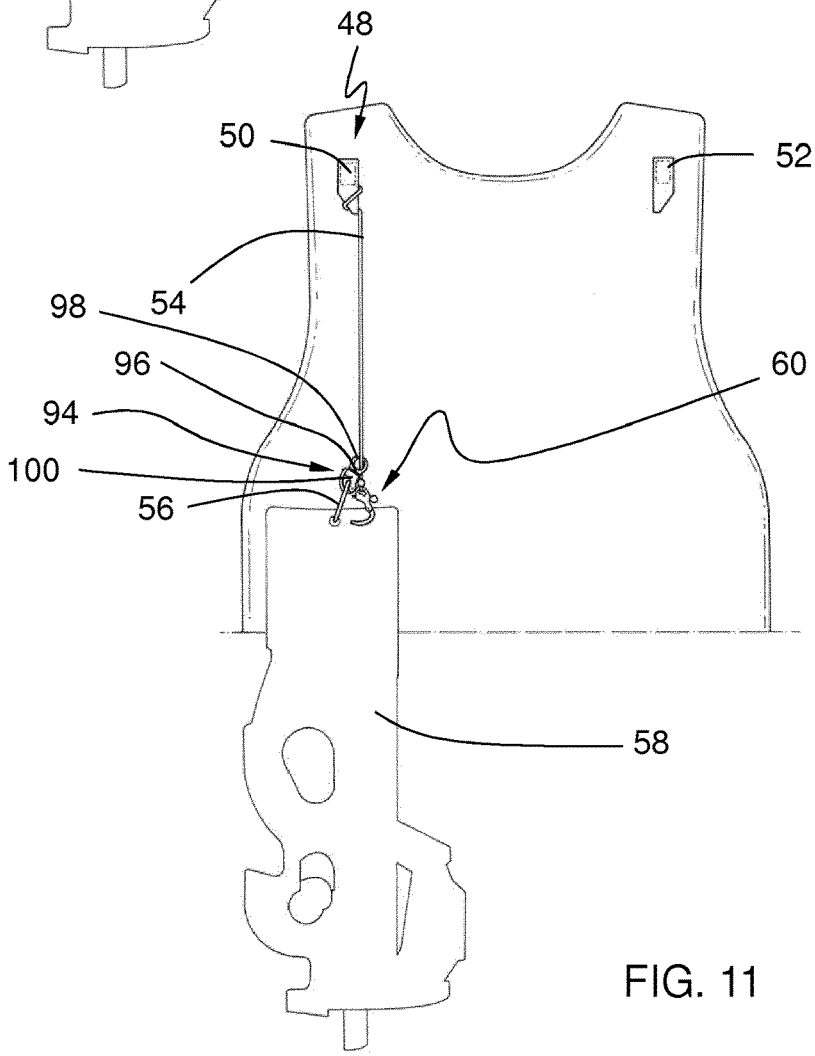
FIG. 11 is a front view of the weapon suspension device in a rest position.

FIGS. 10 and 11 show how the equipment comprises a suspension device 48 for a weapon 58 for solving this problem. This device comprises first and second attachment points 50, 52 on the front area of the equipment 1 at the height of the user's shoulders. These attachment points may be fixtures or rigid, semi-rigid or flexible members, preferably made from textile or synthetic material or natural fibres, attached to the containing cover of the front ballistic package 10 or to the shoulder straps 4 by sewing, fixtures, pull-the-dot fasteners. Between the first and second attachment points 50, 52 there extends a first suspension member 54. Then, transversely relative to the first suspension member, there is provided a second suspension member 56 mounted at a first end, slidingly between the first and second attachment points 50, 52 and at a second end connected to the weapon 58. Both the first and second suspension members 54, 56 may be a cable, strap or cord of metal or synthetic alloy.

Figure 12:
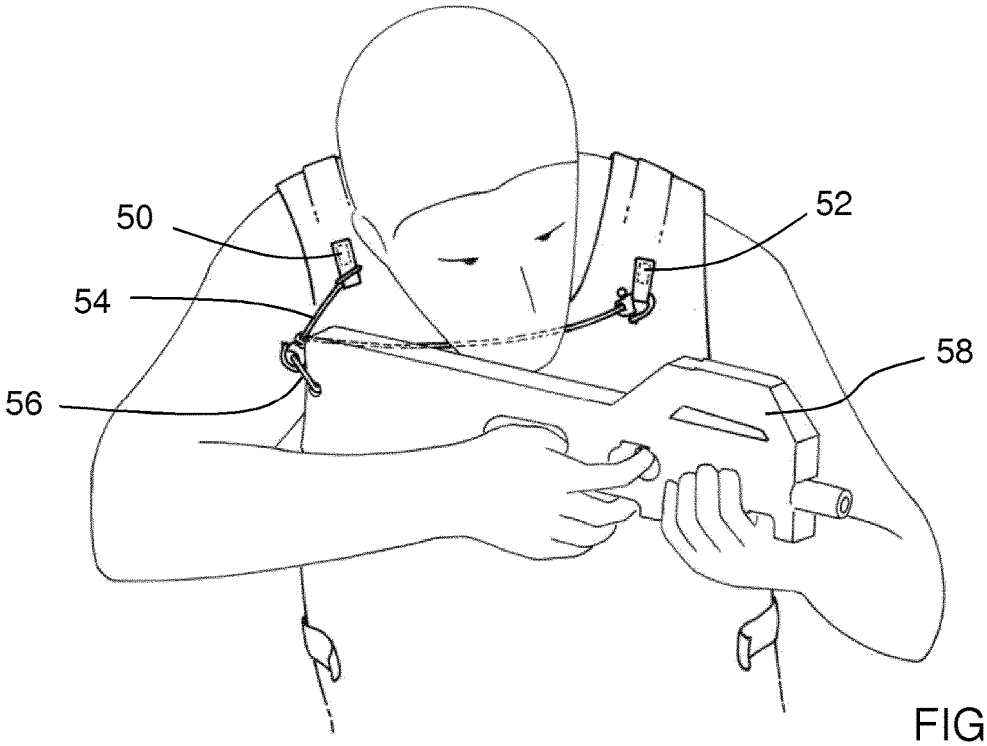
FIG. 12 is a perspective view of the suspension device of FIGS. 10 and 11 with the user in a right-handed firing position.
Figure 13:
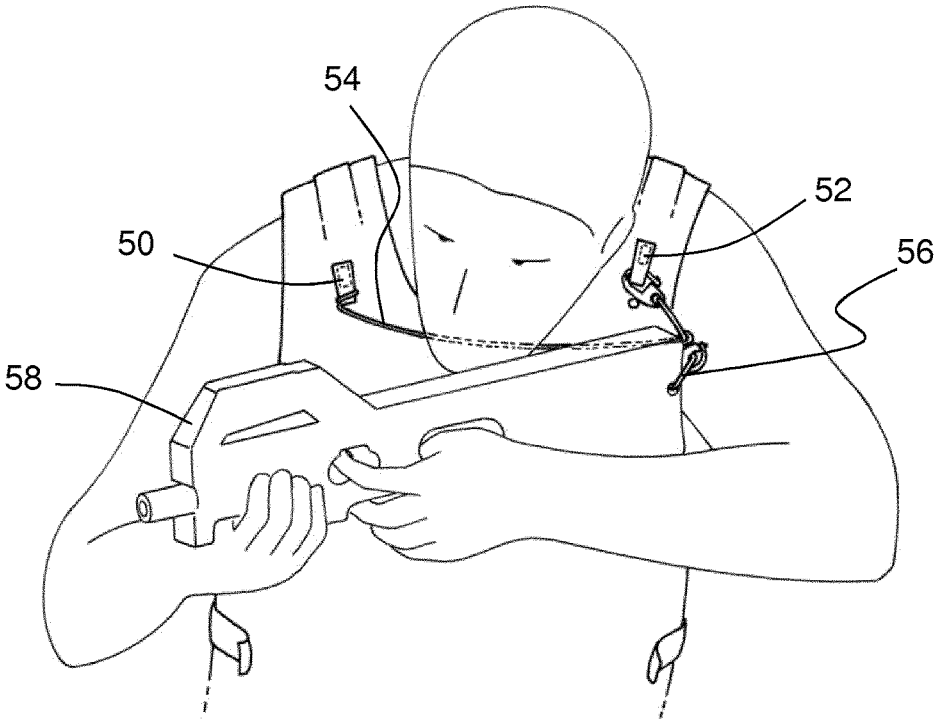
FIG. 13 is a perspective view of the suspension device of FIGS. 10 and 11 with the user in a left-handed firing position.

As shown in FIGS. 12, 13, the suspension device 48 allows ambidextrous use of the weapon 58 by the user, avoiding the exposure of parts of the body during combat. The sliding design along the cord forming the first suspension member 54 facilitates the transition of the weapon 58 from a state of rest to a firing state. Also, thanks to the central suspension, the device does not hinder the resting of the weapon against the user's shoulder.

Further, in the suspension device 48 of this preferred embodiment, the first suspension member 54 has at the right end connecting means 60 with the second attachment point 52 as a spring hook. The spring hook may be opened and closed to uncouple the connection between the first suspension member 54 and the second attachment point 52. This allows the weapon 58 to be placed at the user's side, for example during identification tasks.

Also the second suspension member 56 comprises second connecting means 94 as a spring hook. These second connecting means 94 are formed by a fixed part 98 and a rotary part 100. The fixed part is ring shaped mounted slidingly between the first and second attachment points 50, 52 and has a shaft 96. Then, the rotary part 100 which can rotate relative to the shaft 96 is terminated as a spring hook for hooking the weapon 58. The second connecting means 94 of the weapon 58 may be disconnected to disconnect the weapon 58 from the system, for example, during a change of guard or to replace a defective weapon.

The suspension device 48 has been shown schematically in a containing cover of a front ballistic package. Nevertheless, the suspension device 48 could also be mounted on the shoulder straps 4 of the backpack 2.

On the other hand, in an improvement of the invention for undercover operations, the front ballistic package 10 comprises holding means 62, configured for holding a weapon 58 at the front. As may be seen in the figures, these holding means consist of a lower pocket 102 and a retaining member 104, preferably as an elastic strap. Thanks to these holding means 62, when the front ballistic package 10 is pulled out and the configuration of the equipment 1 is changed from the undercover position to the protection position, the weapon 58 moves together with the front ballistic package 10. Once the user has the front ballistic package 10 in place and has correctly placed the lateral extensions 84, he has the weapon 58 against his chest within hands reach. Thus, to be able to take hold of it, he only has simply to remove the retaining member 104 and draw it from inside the lower pocket 102. Thanks to the weapon 58 being suspended from the suspension device 48, there is no risk of the user losing it, or even of it being seized by a third party during a possible struggle.

The man of the art will understand that multiple variations are possible with respect to the herein described embodiments, without thereby going beyond the scope of the main claim. In particular, variations may be contemplated relative to the shape, dimensions and disposition of the different elements or materials. Also, in spite of not being shown, multiple combinations between the different technical elements of the described embodiments are conceivable.

The invention claimed is:

1. An equipment having a personal protection system suitable for being carried on a user's shoulders comprising: (a) a backpack having two shoulder straps and at least one first upper compartment accessible from the outside through a first operable closing means, (b) a front ballistic package mounted with capability of being pulled out through said first closing means in said first upper compartment comprising (i) an pull-out grip at a first end and (ii) at a second end, opposite to said first end, two connecting members between said front ballistic package and said backpack, spaced apart from one other to allow for the passage of said user's head, wherein a configuration of said equipment is adjustable between (i) an undercover position in which said front ballistic package is inserted in said first upper compartment and said grip projects through said first closing means and is accessible by said user without having to remove the backpack from his shoulders and (ii) a protection position in which said front ballistic package is pulled out from said first upper compartment, facing said backpack such that it is configured for covering at least the vital organs of said user, wherein said equipment further comprises (c) compacting means which connect said front ballistic package with said backpack, such that said first upper compartment can modify the size thereof between (d) an expanded size when said equipment is in the undercover position and (e) a compacted size when said equipment is in the protection position; and wherein said first upper compartment comprises a surface near to the contact surface between said backpack and said user's back and a surface remote from said contact surface, facing said near surface, wherein said compacting means comprise at least one cable connecting said near and remote surfaces and which at least at one end is attached to said front ballistic package, said cable having a length such that when said equipment is in the protection position, said first upper compartment is in the compacted size.

2. The equipment according to claim 1, further comprising a protective rear ballistic package associated with said backpack and configured to protect said user's vital organs from behind and a sacroiliac ballistic package at the bottom area of said equipment, movable between a hidden position and a unfolded position in which said sacroiliac ballistic package covers the user's sacroiliac region.

3. The equipment according to claim 2, wherein said backpack comprises a second independent lower compartment, accessible from the outside through a second operable closing means and containing said sacroiliac ballistic package in such a way that said sacroiliac ballistic package can be pulled out.

4. The equipment according to claim 2, further comprising a sacroiliac ballistic plate functionally connected to said sacroiliac ballistic package and provided at the bottom area of said equipment movable between a hidden position and an unfolded position.

5. The equipment according to claim 1, further comprising a pelvic ballistic package functionally connected to said front ballistic package with said pelvic ballistic package being unfoldable from said first end when said equipment adopts the protection position, such that in said unfoldable position said pelvic ballistic package covers the user's pelvic region.

6. The equipment according to claim 5, further comprising a pelvic ballistic plate functionally connected to said pelvic ballistic package and provided at the bottom area of said equipment when said equipment adopts said protection position, said pelvic ballistic plate being movable between a hidden position and an unfolded position.

7. The equipment according to claim 1, wherein said backpack comprises a harness incorporating an exfiltration anchorage on the contact surface with said user's back.

8. The equipment according to claim 7, wherein said harness comprises firsts straps as leg straps at the bottom area of said backpack and second straps connected to said first straps, which extend from the sacroiliac area to the cervical area of said backpack and are coupled with said exfiltration anchorage.

9. The equipment according to claim 8, further comprising a third independent lower compartment accessible from the outside through a third operable closing means containing said first straps.

10. The equipment according to claim 1, wherein the equipment comprises a weapon suspension device comprising

[a] first and second attachment points provided at the front area of said equipment such that when said equipment adopts the protection position said first and second attachment points are arranged at a the height of said user's shoulders on a containing cover of the front ballistic package or on the shoulder straps,

[b] a first suspension member extending between said first and second attachment points and

[c] a second suspension member transversely mounted at a first end on said first suspension member slidingly between said first and second attachment points and connected to said weapon at a second end.

11. The equipment according to claim 10, wherein said first suspension member has on at least one of the ends thereof, first connecting means with said first or second attachment point, said connecting means being movable between an open position and a closed position to disconnect the connection between said first suspension member and said first or second attachment point.

12. The equipment according to claim 10, wherein said second suspension member comprises second connecting means with a fixed part slidingly mounted between said first and second attachment points and provided with a shaft and a part rotary relative to said shaft.

13. The equipment according to claim 10, wherein said front ballistic package comprises holding means, configured to hold a weapon at the front part of said front ballistic package such that when the configuration of said equipment is changed between the undercover position and the protection position, said weapon is moved fixedly with said front ballistic package.

14. The equipment according to claim 1, further comprising securing means adapted to releasably connect said pull-out grip to said backpack, said securing means being movable between

[a] a securing position in which said grip and said backpack are directly attached to each other through said securing means and

[b] a release position in which said grip is released from said backpack to allow said front ballistic package to be pulled out.

15. The equipment according to claim 14, wherein said securing means comprise at least

[a] one grip eyelet provided on said grip,

[b] a pair of backpack eyelets, spaced apart at least by the width of said grip,

[c] a first longitudinal member configured to be snugly guided through said eyelets, wherein said grip and backpack eyelets and said longitudinal member are configured so that, starting out from said securing position, in which said grip eyelet is aligned between said pair of backpack eyelets and said first longitudinal member is inserted in said grip and backpack eyelets, on passing to said release position, said first longitudinal member is moved at least out of said grip eyelet.

16. The equipment according to claim 15, wherein said longitudinal member is flexible and the end of said first longitudinal member opposite to the end is inserted in said grip and backpack eyelets is connected to a movable blocking member provided on one of said shoulder straps, within the reach of the user's hand, mounted movably at least in the distance between said securing position and said release position of said securing means.

17. The equipment according to claim 1, wherein said first operable closing means comprises

[a] a plurality of closing means eyelets adjacent both sides of said first upper compartment and

[b] a second flexible longitudinal member fixedly mounted projecting from each of the sides of said pull-out grip and which in said undercover position is inserted snugly guided in said plurality of closing means eyelets said second longitudinal member having such a length that when said equipment passes from said undercover position to said protection position, said second longitudinal member is withdrawn from said plurality of closing means eyelets.

18. An equipment having a personal protection system suitable for being carried on a user's shoulders comprising: (a) a backpack having two shoulder straps and at least one first upper compartment accessible from the outside through a first operable closing means, (b) a front ballistic package mounted with capability of being pulled out through said first closing means in said first upper compartment comprising (i) an pull-out grip at a first end and (ii) at a second end, opposite to said first end, two connecting members between said front ballistic package and said backpack, spaced apart from one other to allow for the passage of said user's head, wherein a configuration of said equipment is adjustable between (i) an undercover position in which said front ballistic package is inserted in said first upper compartment and said grip projects through said first closing means and is accessible by said user without having to remove the backpack from his shoulders and (ii) a protection position in which said front ballistic package is pulled out from said first upper compartment, facing said backpack such that it is configured for covering at least the vital organs of said user, wherein said equipment further comprises (c) one or more flexible members configured to connect said front ballistic package with said backpack, such that said first upper compartment can modify the size thereof between (d) an expanded size when said equipment is in the undercover position and (e) a compacted size when said equipment is in the protection position; and wherein said first upper compartment further comprises a surface near to a contact surface between said backpack and a user's back and a surface remote from said contact surface, facing said near surface, wherein a compacting means comprise at least one cable connecting said near and remote surfaces and which at least at one end is attached to said front ballistic package, said cable having a length such that when said equipment is in the protection position, said first upper compartment is in the compacted size.

* * * * *